US005582106A

United States Patent [19]

Kanda et al.

[11] Patent Number: 5,582,106

[45] Date of Patent: Dec. 10, 1996

[54] INDIRECT TYPE LITHOGRAPHIC PRINTING ORIGINAL PLATE

[75] Inventors: Kazunori Kanda, Yao; Hisaichi Muramoto, Hirakata; Yutaka Kanoi, Suita, all of Japan

[73] Assignee: Nippon Paint Co., Ltd., Osaka-fu, Japan

[21] Appl. No.: 438,970

[22] Filed: May 11, 1995

[30] Foreign Application Priority Data

May 12, 1994 [JP] Japan ..... 6-098473

[51] Int. Cl.[6] ..... G03G 5/10

[52] U.S. Cl. ..... 101/462; 430/69; 430/87

[58] Field of Search ..... 101/453, 460, 101/461, 462, 463.1, 465, 466, 467, DIG. 37; 430/56, 69, 87, 300, 302, 310

[56] References Cited

U.S. PATENT DOCUMENTS 4,025,704 5/1977 Trevoy ..... 430/69

4,282,299 8/1981 Suys et al. ..... 430/87

4,379,822 4/1983 Shaw ..... 101/461

4,664,995 5/1987 Horgan et al. ..... 430/69

*Primary Examiner*—Stephen R. Funk

*Attorney, Agent, or Firm*—Wenderoth, Lind & Ponack

[57] ABSTRACT

The present invention provides an indirect type lithographic printing original plate which can afford a high-quality print without causing scumming in the background area. The indirect type lithographic printing original plate includes a substrate and a zinc oxide-dispersed resin layer formed on the surface of the substrate, the substrate being a plastic film or sheet containing 1 to 40% by weight of a polymer antistatic agent having a melting point of not less than 90° C., and wherein the polymer antistatic agent is substantially insoluble in water and isopropyl alcohol.

8 Claims, 1 Drawing Sheet

INDIRECT TYPE LITHOGRAPHIC PRINTING ORIGINAL PLATE

BACKGROUND OF THE INVENTION

The present invention relates to an indirect type lithographic printing original plate. More particularly, it relates to an indirect type lithographic printing original plate which provide a high-quality print without causing scumming in the background area at the time of printing.

DESCRIPTION OF THE RELATED ART

Normally, an indirect type lithographic printing is a method of printing using a lithographic printing original plate comprising a substrate and an image receiving layer, as shown in FIG. 1. The substrate of this original plate is normally composed of a paper or a plastic film, and the image receiving layer is composed of a resin layer obtained by dispersing zinc oxide as a pigment in a resin binder. An offset printing plate can be obtained by forming an image of toner or oil-based ink on the original plate using a normal copying machine, laser printer, thermal transfer printer, etc. to take this image area as a lipophilic ink area (ink receiving layer), then subjecting the area where no toner or oil-based ink is present to a hydrophilization treatment using an etching solution containing potassium cyanate. The resulting offset printing plate is used for printing using an offset printing machine.

As the substrate of this indirect type lithographic printing original plate, a paper is normally used. However, the paper is liable to be broken and is inferior in dimensional stability because of its swelling due to dampening water or ink solvent during printing, which results in poor plate wear. On the other hand, when using the plastic film as the substrate, toner is scattered to the non-image area because of the presence of static electricity in the plastic film, thereby causing a drawback such as scumming at the time of printing.

In Japanese Laid-Open Patent Publication No. 57-148692, there is described that a cationic polymer conductive substance is immersed in or applied on a sheet of a 100% wood pulp as a substrate to adjust a volume resistance within a range of $1\times10^2$ to $1\times10^9$ Ω·cm. However, the conductive substance to be used is a cationic polymer and its molecule is soluble in water or alcohol. Therefore, even if the conductive substance is immersed in the substrate, it is eluted from the plate when an etching solution or dampening water is supplied at the time of printing. As a result, inclusion of the conductive substance into ink causes emulsification/dispersion of ink, which results in poor printing. Further, since a paper (pulp) is normally used in this method, a conventional drawback due to paper can not be solved.

In Japanese Laid-Open Patent Publication Nos. 1-253482 and 4-31087, there is suggested an indirect type lithographic printing original plate comprising a plastic film (e.g. polyethylene terephthalate film, etc.) as the substrate, in which an antistatic agent is applied on a zinc oxide/resin dispersed recording layer, or that in which an antistatic agent is applied on the back surface of the substrate. Since the antistatic agent is merely applied on the surface of the plastic film substrate in these methods, only the surface resistance value of the plate decreases and a volume resistance value, which is effective for solving the fog of toner (or ink), is hardly changed.

Further, in Japanese Laid-Open Patent Publication No. 6-48057, there is suggested an invention in which an alcohol-soluble antistatic agent is contained in the image receiving layer. However, even if the antistatic agent is contained in the image receiving layer, static electricity is accumulated in the substrate because the substrate is composed of the plastic film, therefore the problem in respect to the fog of the toner (or ink) cannot be solved.

OBJECTS OF THE INVENTION

The main object of the present invention is to provide an indirect type lithographic printing original plate comprising a plastic film or sheet as a substrate, which has no drawbacks as described above, and which reduces the fog of the toner (or ink) and does not result in poor printing characteristics.

This object as well as other objects and advantages of the present invention will become apparent to those skilled in the art from the following description with reference to the accompany drawing.

SUMMARY OF THE INVENTION

That is, the present invention provides an indirect type lithographic printing original plate comprising a substrate and a zinc oxide-dispersed resin layer formed on the surface of the substrate, the substrate being a plastic film or sheet containing 1 to 40% by weight of a polymer antistatic agent having a melting point of not less than 90° C., the polymer antistatic agent being substantially insoluble in water and isopropyl alcohol.

DETAILED DESCRIPTION OF THE PREFERRED EMBODIMENTS

Figure 1:
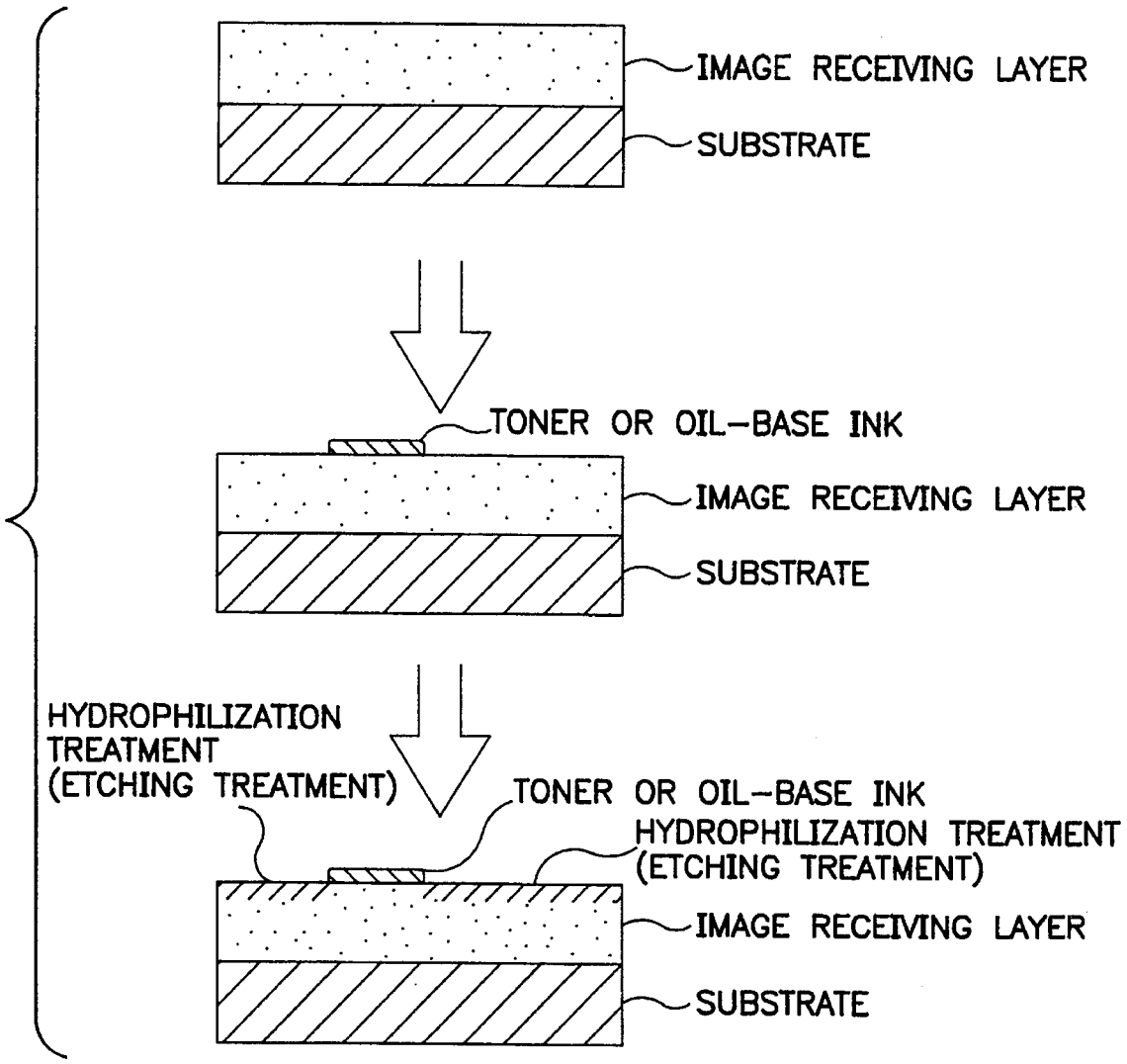
FIG. 1 is a flow sheet illustrating an indirect printing method, schematically.
Figure 2:
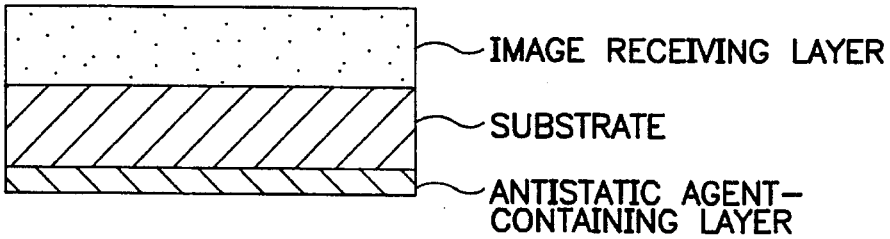
FIG. 2 is an illustration of a substrate and an image receiving layer of FIG. 1 in which the substrate is coated with an adhesive layer containing an antistatic agent therein. This layer is shown on the back surface of the substrate, opposite the image receiving layer, but may be coated on the substrate between the image receiving layer and the substrate.

The antistatic agent used in the present invention is a polymer antistatic agent having a melting point of not less than 90° C., preferably not less than 150° C., which is substantially insoluble in water or isopropyl alcohol. The description "substantially insoluble in water or isopropyl alcohol" in the present specification means that the solubility in hot water or hot isopropyl alcohol is not more than 5% by weight. Further, the solubility in hot water (or hot isopropyl alcohol) is determined as follows. That is, 10 g of an antistatic agent pellet or powder is added in 90 g of water (or isopropyl alcohol), and after stirring at 70° C. for one hour, the mixed solution is filtered off through a glass filter with a filter plate of G3.5 (standard maximum pore size: 16 to 40μ), and then the flitrate is concentrated to determine the amount of solid content dissolved in water (or isopropyl alcohol). Then, the solubility is calculated from the following equation.

Solubility (%) in hot water (or hot alcohol)=[Solid content (g) dissolved/10 g]×100

Further, the polymer antistatic agent having a melting point of not less than 90° C., preferably not less than 150° C., contains a polymer chain moiety having a high melting point in the molecule, and the moiety may have a crystallizability in some cases.

Examples of this kind of antistatic agent include block copolymers comprising a hydrophobic segment composed of a polyamide, a polyester or a combination of a polyamide/polyester and a hydrophilic segment composed of a polyether, wherein the melting point of the polymer prepared from the constituent component of segments alone is not less than 90° C., preferably not less than 150° C. Further, the hydrophilic segment may optionally contain an ionic hydrophilic group selected from the group consisting of a quaternary ammonium salt, a carboxylate, a sulfonate, a phosphate, an amino acid salt and a combination thereof.

The polyester segment comprises a dicarboxylic residue and a diol residue. Examples of the dicarboxylic residue include residues of aromatic dicarboxylic acids, such as terephthalic acid, isophthalic acid, 1,5-naphthalenedicarboxylic acid, diphenyl-4,4'-dicarboxylic acid, 3-sulfoisophthalic acid, 2,6-naphthalenedicarboxylic acid, etc.; residues of alicyclic dicarboxylic acids such as 1,4-cyclohexanedicarboxylic acid, 1,2-cyclohexanedicarboxylic acid, dicyclohexyl-4,4'-dicarboxylic acid, etc.; residues of aliphatic dicarboxylic acids such as oxalic acid, succinic acid, adipic acid, azelaic acid, sebacic acid, etc. Examples of the diol residue include residues of aliphatic, aromatic or alicyclic diols such as ethylene glycol, propylene glycol, tetramethylene glycol, pentamethylene glycol, 2,2-dimethyltrimethylene glycol, hexamethylene glycol, p-xylylene glycol, cyclohexanedimethanol, etc. The polyester segment may be a copolymerized polyester containing a residue of oxy-acids such as p-(β-hydroxyethoxy)benzoic acid, p-oxybenzoic acid, etc. as the copolymeric component on the above polyester, and a polyester comprising a residue of aromatic ether dicarboxylic acids such as 1,2-bis(4,4'-dicarboxymethylphenoxy)ethane, di(4-carboxyphenoxy)ethane, etc. and the same diol residue as that described above. Examples of the particularly useful high melting point polyester segment include a segment of a terephthalic acid-ethylene glycol residue, a segment of a terephthalic acid-tetramethylene glycol residue, a segment of a terephthalic acid-isophthalic acid-ethylene glycol residue, a segment of a terephthalic acid-isophthalic acid-tetramethylene glycol residue and the like.

Further, the polyamide segment comprises a dicarboxylic residue and a diamine residue. Examples of the dicarboxylic residue include dicarboxylic residues described above. Examples of the diamine residue include ethylenediamine, tetramethylenediamine, hexamethylenediamine, phenylenediamine, xylylenediamine, N,N'-bis(amino-n-propyl)piperazine, a bis(p-aminocyclohexyl)methane residue and the like. Further, there can be used a polyamide composed of an aminocarboxylic component, such as aminocapronic acid, aminolauric acid, etc. or a polyamide synthesized by subjecting ε-caprolactam to ring opening polymerization. Examples of the particularly useful high melting point polyamide segment include segments of nylon 6 synthesized from ε-caprolactam, nylon 66 synthesized from hexamethylenediamine and adipic acid, nylon 6,10 synthesized from hexamethylenediamine and sebacic acid, etc.

Examples of the hydrophilic segment of the block copolymer type antistatic agent include polyethers, such as polyethylene oxide glycol, polypropylene oxide glycol, polytetramethylene oxide glycol, a copolymerized glycol of ethylene oxide and propylene oxide, a copolymerized glycol of ethylene oxide and tetrahydrofuran and the like. Further, when the ionic hydrophilic group is introduced, for example, there can be used a production process, comprising adding alkylene oxides such as ethylene oxide, propylene oxide, etc. optionally to diol compounds containing a carboxyl group, such as 3,5-hydroxybenzoic acid, 2,2-bis(hydroxymethyl)propionic acid, 2,2-bis(2-hydroxyethyl)propionic acid, 2,2-bis(3-hydroxypropyl)propionic acid, bis(hydroxymethyl)acetic acid, bis(4-hydroxyphenyl)acetic acid, 4,4-bis(4-hydroxyphenyl)pentanoic acid, tartaric acid, etc.; diol compounds containing a phosphoric group, such as N,N-bis(2-hydroxyethyl)aminomethylphosphonic acid, 1,3-dihydroxypropane-2-phosphonic acid, 1,2-dihydroxypropane-3-phosphonic acid, etc.; diol compounds containing a sulfonic group, such as a hydroquinonesulfonic acid, 3,5-dihydroxy-1- sulfobenzene, 2,2-bis(hydroxymethyl)-1- sulfopropane, 2,2-bis(hydroxyethyl)-1-sulfopropane, 2,2-bis(hydroxypropyl)-1-sulfopropane, 3,6-dihydroxy-1-sulfocyclohexane, etc.; diol compounds containing a quaternary ammonium base, such as dipolyoxyethylene dodecylammonium chloride, dipolyoxyethylene octadecylammonium bromide, etc.; diol compounds containing an amino acid group, such as dihydroxyethyltaurine, dihydroxypropyltaurine, etc.; and then neutralizing an acid group introduced into the polymer with an alkali such as sodium hydroxide, etc. Further, in order to introduce a quaternary ammonium salt into a polyether, required mols of the above alkylene oxides may be added to a diol containing a tertiary amino group, such as N-butyldiethanolamine, followed by treating with diethyl sulfate to quaternize the nitrogen. Examples of the particularly useful segment include segments of polyethers obtained by subjecting ethylene oxide or propylene oxide to single polymerization or copolymerization.

Among the above copolymers comprising a hydrophobic segment and a hydrophilic segment, useful examples of the block copolymer type antistatic agent used in the present invention include polyester polyether block copolymers such as polyethylene terephthalate-polyethylene oxide block copolymers, polytetramethylene terephthalate-polyethylene oxide block copolymers, polyethylene terephthalate-polytetramethylene oxide block copolymers, polytetramethylene terephthalate-polytetramethylene oxide block copolymers, polyethylene terephthalate-polyethylene oxide polypropylene oxide block copolymers, etc.; polyamide polyether block copolymers such as nylon 6-polyethylene oxide block copolymers, nylon 6,6-polyethylene oxide block copolymer, nylon 6,10-polyethylene oxide block copolymers, etc.; three-dimensional block copolymers (polyamide polyester polyether block copolymers) such as nylon 6opolyethylene terephthalate-polyethylene oxide block copolymers, nylon 6,6-polyteteramethylene terephthalate-polyethylene oxide block copolymers, etc. The production method of these block copolymers are not specifically limited, and they are obtained by a normal known method, for example, synthetic method described in Japanese Patent Publication No. 55-39246, Japanese Laid-Open Patent Publication No. 61-31456, etc.

The amount of the block copolymer to be formulated in the film is 1 to 40% by weight, preferably 3 to 30% by weight. Further, the amount obtained by converting it into that of the hydrophilic segment is 0.5 to 20% by weight, preferably 1.5 to 15% by weight. When the amount of the hydrophilic segment is smaller than 0.5% by weight, based on the weight of the polymer composition for forming the film, the objective effect of the present invention is insufficient. On the other hand, when the amount exceeds 15% by weight, the effect is scarcely increased but it has harmful effects such as the deterioration of physical properties (e.g. strength, etc.) of the film.

When the image receiving layer is developed, the toner or ink is thermally fixed or thermally transferred by the printing material, and it is necessary that the substrate has an appropriate thermal dimensional stability because it is heated at about 120° to 160° C. for several minutes. Therefore, as the substrate, there can be preferably used films of plastics such as polyolefin (e.g. polyethylene, polypropylene, etc.), polyester and the like. Among them, films of polyester such as polyethylene terephthalate, polybutyrene terephthalate, poly-1,4-cyclohexanedimethylene terephthalate, etc. are preferably used.

In the present invention, the antistatic substrate can be prepared by melting and kneading the polymer antistatic agent and plastic, followed by forming into a sheet. The melting and kneading can be conducted by a known method. For example, pellets of both a polymer antistatic agent and a plastic are molten and mixed at high temperature, i.e. about 200° to 280° C., and the molten mixture then formed into a sheet. It is preferred that the plastic sheet is further subjected to biaxial orientation to enhance the orientation properties of the molecule in the planar direction, thereby improving the mechanical strength. It is preferred that the thickness of the finished substrate is within a range of 40 to 300μ. When the thickness of the substrate is less than 40μ, wrinkles due to thermal deformation are formed in the film at the time of toner fixing or ink transferring in the interior of the printer in the above developing process and, therefore, it becomes impossible to use it as the printing plate, sometimes. On the other hand, when the thickness of the substrate exceeds 300μ, it becomes difficult to fit it with a plate cylinder of a portable printing machine, which constitutes a hindrance to printing. Further, it also becomes difficult to decrease the volume resistance to the desired value.

An undercoat layer (intermediate layer) may optionally be provided between the substrate and zinc oxide/resin dispersed layer (image receiving layer) so as to improve the adhesion between them. The undercoat layer is mainly composed of an adhesive, and various antistatic agents (e.g. cationic, anionic, nonionic or ampholytic antistatic agents) may be formulated. There can be used any composition described in known techniques, such as saponified polyvinyl alcohol/isobutyreneomaleic anhydride copolymers (Japanese Laid-Open Patent Publication No. 5-318678), urethane resins (Japanese Laid-Open Patent Publication No. 5-64990), aromatic polyester resins/antistatic agents (Japanese Laid-Open Patent Publication No. 5-320391) and the like.

Further, the surface of the film may be subjected to a plasma treatment to increase the adhesion, in addition to providing an undercoat layer on the substrate film.

The image receiving layer contains zinc oxide and a binder resin as an essential component, and it may optionally contain various additives.

The pigment to be dispersed in the image receiving layer is mainly zinc oxide. The zinc oxide is classified into two types, i.e. that obtained by a dry process and that obtained by a wet process (active zinc white). In the present invention, there can be used any one of these types or a mixture thereof. In the present invention, the amount of zinc oxide is preferably 75 to 90%, based on the total weight of the image receiving layer. When the amount of zinc oxide is less than 75%, the amount of zinc oxide exposed on the surface of the image receiving layer is decreased so that the total surface of the plate is not hydrophilized sufficiently and uniformly even if it is subjected to the etching treatment. Therefore, scumming in the background area is apt to arise at the time of printing, and it is not preferable to use lesser amounts. On the other hand, when the amount exceeds 90%, the amount of the binder resin to be formulated becomes small and, therefore, it becomes difficult to provide a sufficient fixing of the pigment, and it is not preferred.

Examples of the binder resin to be used for the image receiving layer in the lithographic printing plate material of the present invention include lipophilic resins, such as an acrylic resin, a polyvinyl chloride, a polyvinyl acetate, polystyrene, a silicone resin, SBR, NBR, a polyester resin, an epoxy resin, etc. or a hydrophilic resin (including an emulsion resin such as a polyvinyl alcohol, carboxymethylcellulose, casein, gelatin, ammonium acrylate, etc. These resins may be used alone or in combination thereof. In the present invention, the amount of the binder resin is preferably 10 to 25%, based on the total weight of the image receiving layer, so as to supplement the amount of the above zinc acid.

A suitable amount of various additives such as antistatic agents, plasticizers, extender pigments, etc. may be optionally formulated in the image receiving layer, in addition to the above main components.

In order to make it difficult to cause toner scattering in the non-image area, it is necessary that the surface resistance of the surface or back surface of the image receiving layer be $10^9$ to $10^{13}$ Ω/□. In this case, the surface resistance of one surface or both surfaces may be within the above range. Most preferably, the surface resistance of both surfaces is within the above range. Further, when a layer containing the antistatic agent in the back surface is provided, the layer containing the antistatic agent can be provided by applying the antistatic agent alone or in combination with the binder resin used for forming the image receiving layer.

As the antistatic agent, there can be used ionic or nonionic antistatic agents which are normally used for the plastic film. As the ionic antistatic agent, there can be used antistatic agents containing at least one hydrophilic group selected from the group consisting of quaternary ammonium salts, carboxylates, sulfonates, phosphates, amino acid salts and a mixture thereof in the molecule. As the nonionic antistatic agent, there can be used those containing a polyether bond group in the molecule.

Examples thereof include nonionic compounds such as polyethylene glycol, polyoxyethylenediamine, etc.; cationic compounds such as polyvinylbenzyltrimethylammonium chloride, quaternized polydimethylaminoethyl methacrylate, polydiallyldimethylammonium chloride, etc.; anionic compounds such as sodium polystyrene sulfonate, long-chain alkoxypolyoxyethylene phosphoric acid potassium, ampholytic compounds such as N,N-dimethyl-N-stearyl-N-(3-sulfopropyl)-ammonium betaine, etc. Additional examples include those which are used in Japanese Laid-Open Patent Publication Nos. 1-253482, 4-31087, 6-48057, etc. There can be preferably used those which are substantially insoluble or nonsoluble in water. The antistatic agent to be used in the back surface may be soluble or insoluble in water or alcohol because it is scarcely mixed with dampening water or ink.

Further, it is also possible to impart suitable antistatic properties by providing a layer of conductive polymers such as polyacetylene, polythiophene, polypyrrole, etc. on the surface. The surface resistance after the above treatment is $10^9$ to $10^{13}$ Ω/□, more preferably $10^{10}$ to $10^{12}$ Ω/□. When it is $10^9$ Ω/= or less, sufficient charge can not be applied to the substrate in case of toner transfer and, therefore, the toner transfer becomes insufficient, thereby obtaining poor toner image. When it is $10^{13}$ Ω/□ or more, the effect as the surface antistatic agent is insufficient and the effect for preventing toner scattering is insufficient.

The suitable coating weight (dry basis) per unit area of the image receiving layer in the printing plate of the present invention is within a range of 3 to 30 g/m$^2$. When the coating weight is less than 3 g/m$^2$, the thickness of the image receiving layer is too thin so that hydrophilization is not conducted sufficiently and uniformly by means of the etching treatment, thereby causing scumming in the background area. Further, scumming in the background area is liable to arise as a result of wear during printing. On the other hand, when the coating weight exceeds 30 g/m$^2$, the volume resistance of the image receiving layer can not be ignored and a fog of the toner or ink (scattering in the non-image area) is liable to arise at the time of forming the image, and it is not preferred to use such large amounts.

It is necessary that the non-image area of the printing material be subjected to an oil-repellent treatment (hydrophilization treatment) in advance at the time of printing after the image was formed with toner or ink. The oil-repellent treatment is a treatment to convert non-imaged portions in an imaged plate to a desired water-receptive, ink-repellent condition. An etching solution containing a ferrocyanide compound is normally used for the oil-repellent treatment, and examples thereof include those described in U.S. Pat. Nos. 3,672,885 and 3,661,598, Japanese Laid-Open Patent Publication Nos. 5-338371, 53-49506, 53-49507, 57-199694, 53-63101, 52-134501 and 52-126302, Japanese Patent Publication No. 60-12958, etc. The etching solution may contain lower alcohols, such as isopropyl alcohol, which causes a decrease in surface tension of water to enhance the wettability to the plate. The etching treatment is conducted by rubbing the image receiving surface of the plate with an absorbent wadding soaked with the etching solution.

In the present invention, since the prescribed antistatic agent is molten at high temperature and kneaded with a plastic film, such as polyethylene terephthalate, it is finely dispersed in the film. As a result, static electricity flows through the interior and, therefore, the volume intrinsic value can be decreased to $10^8$ to $10^{13}$ Ω·cm, preferably $10^9$ to $10^{12}$ Ω·cm. Accordingly, fog due to scattering can be extremely decreased when a toner (or ink) image is formed in a lithographic printing plate in which an image forming layer containing zinc oxide is provided on a substrate thereof. Furthermore, since the above antistatic agent is substantially insoluble in water or isopropyl alcohol, it is not eluted with water or aqueous/alcoholic dampening water and a poor printing due to emulsification/dispersion of ink can be solved.

EXAMPLES

The following Examples and Comparative Examples further illustrate the present invention in detail but are not to be construed to limit the scope thereof. In the Examples and Comparative Examples, "parts" and "% s" are by weight unless otherwise stated.

Example 1

85 parts of polyethylene terephthalate and 15 parts of a polyester polyether block copolymer (Pellestat 6000, manufactured by Sanyo Kasei Co., Ltd.) as an antistatic agent were kneaded at about 280° C. using a twin-screw extruder to form into a sheet. The resulting non-oriented film was subjected to biaxial orientation to give an antistatic-finished substrate film having a film thickness of 75μ. The volume resistance value of the substrate film was measured according to JIS C 2318. As a result, it was $1.00\times10^{13}$ Ω·cm.

Further, the melting temperature, solubility in hot water and solubility in hot isopropyl alcohol of the polyester polyether block copolymer used hereinabove were 200° C., 2.2% and 2.8%, respectively. The surface of the substrate was subjected to a plasma treatment to impart an easy adhesion, then a paint having the following composition was applied so that the dry coating weight may become 10 g/m$^2$ using a bar coater, followed by drying at 60° C. for 20 minutes.

<Paint 1 for forming image receiving layer>

| Component | Amount (parts) |
|---|---|
| Zinc oxide (SAZEX #2000, manufactured by Sakai Kagaku Co., Ltd.) | 56 |
| Acrylic resin (Dianal LR-188, manufactured by Mitsubishi Rayon Co., Ltd.) | 10 |
| Maleic anhydride | 1 |
| Toluene | 33 |

The above formulation components and 30 parts of glass beads were charged in a sample tube and the mixture was dispersed with a paint shaker for 2 hours to give a prescribed paint.

A toner image was formed on the resulting lithographic printing original plate using a laser printer (Unity 1200 XLJ, manufactured by Master Co., U.S.A). As a result, there could be observed little fog due to toner scattering in the non-image area. This plate was subjected to an oil-repellent treatment using a cyanogen etching solution manufactured by A. B. Dick Co., U.S.A., then attached to a portable offset printing machine, Hamadastar 662XL manufactured by Hamada Insatsu Kikai Seisakusho Co., Ltd. to print on a fine-quality paper with commercially available ink. As a result, little scumming caused by fog due to toner scattering was observed in the resulting print and twenty thousand copies could be printed satisfactorily without causing poor printing due to elution of the antistatic agent during printing.

Example 2

According to the same manner as that described in Example 1, 70 parts of polyethylene terephthalate and 30 parts of a nylon 6-polyethylene terephthalate-polyethylene oxide block copolymer as an antistatic agent were kneaded to obtain an antistatic-finished substrate film (volume resistance value: $8.24\times10^9$ Ω·cm) having a film thickness of 80μ. Further, the melting temperature, solubility in hot water and solubility in hot isopropyl alcohol of the block copolymer used hereinabove were 220° C., 2.3% and 2.6%, respectively.

According to the same manner as that described in Example 1, the surface of the resulting substrate was subjected to the same treatment to impart an easy adhesion, then an image receiving layer was applied.

An ink image was formed on the resulting lithographic printing original plate using a thermal transfer printer (Toshiba Rupo 95G). As a result, there could be observed little ink transferred from an ink ribbon to the non-image area. According to the same manner as that described in Example 1, this plate was subjected to a printing test. As a result, little scumming was observed in the resulting print and twenty thousand copies could be printed satisfactorily without causing poor printing due to elution of the antistatic agent.

Example 3

According to the same manner as that described in Example 1, 80 parts of polyethylene terephthalate and 20 parts of a nylon 6,6-polyethylene oxide block copolymer as an antistatic agent were kneaded to obtain an antistatic-finished substrate film (volume resistance value: $1.00\times10^{11}$ Ω·cm) having a film thickness of 150μ. Further, the melting temperature, solubility in hot water and solubility in hot isopropyl alcohol of the block copolymer used hereinabove were 250° C., 3.1% and 3.5%, respectively. According to the same manner as that described in Example 1, the surface of the resulting substrate was subjected to the same treatment to impart an easy adhesion, then a paint having the following composition was applied so that the dry coating weight may become 10 g/m$^2$ using a bar coater, followed by drying.

<Paint 2 for forming image receiving layer>

| Component | Amount (parts) |
|---|---|
| Zinc oxide (SAZEX #2000, manufactured by Sakai Kagaku Co., Ltd.) | 32 |
| Acrylic resin emulsion (Alon A-104, solid content: 45%, manufactured by Toa Gosei Kagaku Co., Ltd.) | 20 |
| Antistatic agent (Nopcostat 092, manufactured by Sunnopco Co.) | 0.2 |
| Methanol | 0.8 |
| Water | 47 |

A toner image was formed on the resulting lithographic printing original plate using a laser printer (Unity 1200 XLJ, manufactured by Master Co., U.S.A). As a result, there could be observed little fog due to toner scattering in the non-image area. According to the same manner as that described in Example 1, this plate was subjected to a printing test. As a result, little scumming in the background area was observed in the resulting print and twenty thousand copies could be printed satisfactorily without causing failures such as emulsification of ink during printing.

Example 4

The following antistatic coating composition was applied on one surface of the polyethylene terephthalate film into which a polymer antistatic agent was formulated in Example 1 so that the dry coating weight may become 5 g/m$^2$ using a bar coater, followed by drying at 60° C. for 30 minutes.

<Antistatic coating composition>

| Component | Amount (parts) |
|---|---|
| Antistatic agent (Nopcostat 092, manufactured by Sunnopco Co.) | 10 |
| Acrylic resin emulsion (Alon A-104, solid content: 45%, manufactured by Toa Gosei Kagaku Co., Ltd.) | 40 |
| Methanol | 3 |
| Water | 47 |

The volume resistance value of the coating surface of the resulting antistatic coating film was $1.00\times10^{12}$ Ω/□. The back surface (non-coated surface) of the substrate was subjected to a plasma treatment to impart an easy adhesion, then the paint 2 for forming image receiving layer of Example 3 was applied so that the dry coating weight may become 10 g/m$^2$ using a bar coater, followed by drying at 60° C. for 20 minutes.

A toner image was formed on the resulting lithographic printing original plate using a laser printer (Unity 1200 XLJ, manufactured by Master Co., U.S.A). As a result, there could be observed extremely little fog due to toner scattering in the non-image area in comparison with the results of Example 1. According to the same manner as that described in Example 1, this plate was subjected to a printing test. As a result, little scumming in the background area was observed in the resulting print and twenty thousand copies could be printed satisfactorily without causing failures such as emulsification of ink during printing.

Comparative Example 1

The surface of a biaxially oriented polyethylene terephthalate film (volume resistance value: $1.2\times10^{15}$ Ω·cm) having a film thickness of 100μ was subjected to a plasma treatment to impart an easy adhesion, then a paint having the same composition as that of Example 1 was applied so that the dry coating weight may become 10 g/m$^2$ using a bar coater, followed by drying at 60° C. for 20 minutes to form an image receiving layer. A toner image was formed on the resulting lithographic printing original plate using a laser printer (Unity 1200 XLJ, manufactured by Master Co., U.S.A). As a result, considerable fog due to toner scattering was observed in the non-image area. This plate was subjected to an oil-repellent treatment using a cyanogen etching solution manufactured by A. B. Dick Co., U.S.A., then attached to a portable offset printing machine, Hamadastar 662XL manufactured by Hamada Insatsu Kikai Seisakusho Co., Ltd. to print on a fine-quality paper with commercially available ink. Considerable scumming caused by fog due to toner scattering was also observed in the resulting print.

Comparative Example 2

85 parts of polyethylene terephthalate and 15 parts of polyethylene glycol (average molecular weight: 20,000) as an antistatic agent were kneaded using a twin-screw extruder to form into a sheet. However, the resulting sheet was considerably cloudy and the antistatic agent could not be micro-dispersed. The non-oriented film was subjected to biaxial orientation to give an antistatic-finished substrate film having a film thickness of 100μ. The volume resistance value of the substrate film was $2.61\times10^{14}$ Ω·cm. Further, the melting temperature, solubility in hot water and solubility in hot isopropyl alcohol of the antistatic polyethylene glycol used hereinabove were 63° C., 69% and 98%, respectively. The surface of the resulting substrate was subjected to a plasma treatment to impart an easy adhesion, then an image receiving layer was provided according to the same manner as that described in Example 1. A toner image was formed on the resulting lithographic printing original plate using a laser printer (Unity 1200 XLJ, manufactured by Master Co., U.S.A). As a result, there could be observed considerable fog due to toner scattering in the non-image area. This plate was subjected to an oil-repellent treatment using a cyanogen etching solution manufactured by A. B. Dick Co., U.S.A., then attached to a portable offset printing machine, Hamadastar 662XL manufactured by Hamada Insatsu Kikai Seisakusho Co., Ltd. to print on a fine-quality paper with commercially available ink. As a result, considerable scumming caused by fog due to toner scattering was observed in the resulting print. Further, scumming in the non-image area of the plate, which is considered to be caused by emulsification/dispersion of ink, has become considerably severe since the point at which one thousand of copies was completed in the printing process, resulting in considerable scumming in the background area.

Comparative Example 3

90 parts of polyethylene terephthalate and 10 parts of sodium polystyrene sulfonate (average molecular weight: 70,000) as an antistatic agent were kneaded at about 280° C. using a twin-screw extruder to form into a sheet. However, the resulting sheet was considerably cloudy and the antistatic agent could not be micro-dispersed. The non-oriented film was subjected to biaxial orientation to give an antistatic-finished substrate film having a film thickness of 100μ. The volume resistance value of the substrate film was $8.35\times10^{13}$ Ω·cm. Further, the melting temperature, solubility in water and solubility in hot isopropyl alcohol of the antistatic sodium polystyrene sulfonate used hereinabove were 250° C., 98% and not more than 3%, respectively. The surface of the resulting substrate was subjected to a plasma treatment to impart an easy adhesion, then an image receiving layer was provided according to the same manner as that described in Example 1. A toner image was formed on the resulting lithographic printing original plate using a laser printer (Unity 1200 XLJ, manufactured by Master Co., U.S.A). As a result, there could be observed considerable fog due to toner scattering in the non-image area. This plate was subjected to an oil-repellent treatment using a cyanogen etching solution manufactured by A. B. Dick Co., U.S.A., then attached to a portable offset printing machine, Hamadastar 662XL manufactured by Hamada Insatsu Kikai Seisakusho Co., Ltd. to print on a fine-quality paper with commercially available ink. As a result, considerable scumming caused by fog due to toner scattering was observed in the resulting print. Further, scumming in the non-image area of the plate, which is considered to be caused by emulsification/dispersion of ink, had become considerably severe, since the point at which one thousand of copies was completed in the printing process, resulted in considerable scumming in the background area.

What is claimed is:

1. An indirect type lithographic printing original plate comprising a substrate and a zinc oxide-dispersed resin layer formed on the surface of the substrate, the substrate being a plastic film or sheet containing 1 to 40% by weight of a polymer antistatic agent having a melting point of not less than 90° C., the polymer antistatic agent being substantially insoluble in water and isopropyl alcohol.

2. The indirect type lithographic printing original plate according to claim 1, wherein a volume intrinsic resistance of the substrate is $10^8$ to $10^{13}$ Ω·cm.

3. The indirect type lithographic printing original plate according to claim 1, wherein a solubility of the polymer antistatic agent in water is not more than 5% and that in isopropyl alcohol is not more than 5%.

4. The indirect type lithographic printing original plate according to claim 1, wherein the polymer antistatic agent is a block copolymer comprising a hydrophilic segment and a hydrophobic segment.

5. The indirect type lithographic printing original plate according to claim 4, wherein the hydrophilic segment is a polyether bond group and/or an ionic hydrophilic group.

6. The indirect type lithographic printing original plate according to claim 5, wherein the hydrophilic segment is an ionic hydrophilic group selected from the group consisting of quaternary ammonium salt, a carboxylate, a sulfonate, a phosphate, an amino acid salt and a combination thereof.

7. The indirect type lithographic printing original plate according to claim 1, wherein a layer containing an antistatic agent is formed on a surface of the substrate, wherein a surface resistance is $10^9$ to $10^{13}$ Ω/□.

8. A printing process which comprises forming a lipophilic toner image using an electrostatic transfer type copying machine or a laser printer, or forming a lipophilic ink image using a thermal transfer type printer or an ink-jet type printer, on an indirect type lithographic printing original plate, hydrophilizing the original plate by means of an etching treatment to make a printing plate, followed by printing by means of an offset printing machine, wherein said indirect type lithographic printing original plate comprises a substrate and a zinc oxide-dispersed resin layer formed on the surface of the substrate, the substrate being a plastic film or sheet containing 1 to 40% by weight of a polymer antistatic agent having a melting point of not less than 90° C., the polymer antistatic agent being substantially insoluble in water and isopropyl alcohol.

* * * * *